United States Patent [19]

Holmstrand

[11] Patent Number: 4,866,886

[45] Date of Patent: Sep. 19, 1989

[54] TEXTURED LAPPING PLATE AND PROCESS FOR ITS MANUFACTURE

[75] Inventor: Allan L. Holmstrand, Bloomington, Minn.

[73] Assignee: Magnetic Peripherals Inc., Minnetonka, Minn.

[21] Appl. No.: 261,751

[22] Filed: Oct. 24, 1988

Related U.S. Application Data

[62] Division of Ser. No. 123,954, Nov. 23, 1987, Pat. No. 4,821,461.

[51] Int. Cl.[4] ..... B24D 18/00

[52] U.S. Cl. ..... 51/307; 51/293

[58] Field of Search ..... 51/293, 295, DIG. 6, 51/307, 209 R, 204 R, 319, 320, 321, 326, 324; 72/53

[56] References Cited

U.S. PATENT DOCUMENTS

| | | | |
|---|---|---|---|
| 3,041,799 | 7/1962 | Kemman | 51/209 R |
| 3,246,430 | 4/1966 | Hurst | 51/293 |
| 3,287,862 | 11/1966 | Abernathy | 51/296 |
| 3,869,263 | 3/1975 | Greenspan | 51/395 |

FOREIGN PATENT DOCUMENTS

| | | | |
|---|---|---|---|
| 0570279 | 2/1959 | Canada | 51/319 |
| 0778811 | 7/1957 | United Kingdom | 51/309 |

*Primary Examiner*—Robert Rose

*Attorney, Agent, or Firm*—Edward P. Heller, III; Frederick W. Niehbuhr

[57] ABSTRACT

A lapping plate is selectively textured for improved useful life and greater abrading consistency. Glass beads are serially propelled onto a lapping surface of the lapping plate in order to form spherical cavities of generally uniform size and distribution, and of a desired density. The cavities provide discontinuity in the lapping surface which substantially prevents workpiece hydroplaning. The cavities also receive loose abrading grit, workpiece fragments and other contaminants, resulting in more smoothly machined workpiece surfaces. Use of the lap plate with cavities also has been found to improve the co-planarity of composite magnetic transducing heads.

11 Claims, 2 Drawing Sheets

TEXTURED LAPPING PLATE AND PROCESS FOR ITS MANUFACTURE

This is a divisional of application Ser. No. 07/123,954, filed Nov. 23, 1987 now U.S. Pat. No. 4,821,461.

BACKGROUND OF THE INVENTION

This invention relates to the manufacturing of abrading tools, and particularly to forming the abrading surfaces of lapping plates used in high precision lapping of magnetic transducing heads.

Magnetic transducing heads, used to store and retrieve data on rotatable magnetic recording discs, call for fine manufacturing tolerances, often measured in microinches (millionths of an inch). Thin film heads typically are formed by applying layers of an electrically conductive material and a magnetic flux conducting core or pole-piece material along one side of a comparatively large body or slider. In use, a finely machined planar bottom surface of the slider is spaced vertically apart from a horizontal magnetic recording surface of the rotating magnetic disc, supported by a thin film of air. To form the transducer bottom surface, high precision abrading equipment is used, including a rotating lapping plate having a horizontal lapping surface in which abrasive particles such as diamond fragments are embedded. An abrasive slurry, for example a water soluble glycol base containing diamond fragments or other abrasive particles, is applied to the lapping surface as the lapping plate is rotated relative to the slider or sliders maintained against the lapping surface. The diamond fragments can be from one to two hundred and fifty microinches in diameter. An example of such lapping plate, along with a carrier arm for maintaining a slider bar or other workpiece against the lapping plate, is disclosed in U.S. Pat. No. 4,536,992 (Hennenfent et al).

Common practice is to periodically refurbish the plates with a lapping grit, to produce a surface texture suitable for the embedding and retention of the appropriate size of diamond grit being used with the lapping process. A problem with this is that the surface is susceptible to a rapid change in smoothness as it is used to lap a workpiece, principally due to fragments removed from the workpiece during lapping. The change in smoothness affects the hydrodynamic bearing film provided by the liquid component of the abrasive slurry, creating a "hydroplaning" effect which raises the workpiece from the lapping surface, to diminish the abrasive action of the particles and substantially increase abrading time.

The general idea of interrupting the lapping surface, for example by forming grooves in a lapping plate, is known in the art. For example, U.S. Pat. No. 3,921,342 (Day) shows a lapping plate 12 in which a plurality of troughs are formed in the lapping surface. A filler of material can be placed in the troughs, so that unspent abrasive liquid is maintained adjacent the working surface of the lapping plate, while spent abrasive fluid is centrifugally removed beyond the lap plate periphery. In U.S. Pat. No. 4,037,367 (Kruse), grooves are formed between working surface areas in which an abrasive such as diamond particles are embedded in a metallic coat. The grooves sweep beneath the workpiece to remove abrasive particles as the abrasive disc rotates. Kruse teaches the depth of the groove should be at least twice the nominal diameter of the particles, and the groove width should be at least ten times the nominal diameter. U.S. Pat. No. 3,683,562 (Day) also discloses a grooved lapping plate.

A problem with grooved plates, however, is due to excessive width and depth of grooves. Abrasive particles entering excessively deep grooves are in effect lost, as they become too far removed from the workpiece surface to provide any further abrasive action. This removal of the grit may be caused by steep, nearly vertical side walls of the grooves, as well as the groove depth. Further, the wide grooves provide a surface discontinuity too severe for small workpieces. Forming such grooves is costly and time consuming. Even if the grooves can be sized properly, substantial segments of the lapping surface remain ungrooved, or alternatively a prohibitively large number of grooves are required. Surface uniformity—on the microscopic scale suitable for lapping small workpieces—could be achieved only with extreme care. Refurbishment of such a lapping surface would require renewal of the grooves as well, further adding to the expense.

Therefore it is an object of the present invention to provide a lapping tool having a selected texture for discontinuity over its lapping surface, and on a microscopic scale appropriate for lapping small workpieces.

Another object is to provide a textured lapping surface which is substantially uniform.

Another object is to provide a process for forming, in a lapping tool, a substantially uniform textured lapping surface, while avoiding the expense of cutting grooves in the lapping plate.

Yet another object of the invention is to provide a lapping tool having a uniformly textured lapping surface amenable to repeated refurbishment by conventional processes.

SUMMARY OF THE INVENTION

To achieve these and other objects, there is provided an abrading tool comprising a lapping body having a substantially horizontal lapping surface and a plurality of first abrasive particles fixed to the lapping surface. The lapping surface is adapted for surface engagement with a workpiece and further for supporting an abrasive slurry, with the lapping body being movable horizontally with respect to the workpiece for lapping a surface of the workpiece through the abrasive action of the first abrasive particles and of a plurality of second abrasive particles suspended in the abrasive slurry. A plurality of generally spherical depressions are formed in the lapping surface, spaced apart from one another, generally uniformly distributed over the lapping surface, and combining to comprise from twenty-five percent to sixty-five percent of the surface area of the lapping surface. The depressions have diameters in the range of from two to twenty thousandths of an inch, with a depth of each depression being less than one-fourth of its diameter.

Preferably, the depressions comprise from forty to fifty percent of the lapping surface area, with the depressions having diameters ranging from three to six thousandths of an inch and depths of less than one-sixth the diameter. As one example, the depressions or cavities can have a diameter of about five thousandths of an inch, and a depth of seven hundred microinches, and together cover approximately forty-five percent of the lapping surface. So arranged, the depressions interrupt the planarity of the lapping surface to reduce the hydrodynamic film from the abrasive slurry, permitting the workpiece to interact more intimately with the lapping plate. This substantially reduces the above-mentioned hydroplaning, a particular advantage when curved surfaces are to be formed in the sliders, as described in the aforementioned U.S. Pat. No. 4,536,992, for more uniform curvature. The cavities provide volumes for removal of particulate contaminants from the workpiece being lapped, and thus reduce scratching of the workpieces. At the same time, it is believed that the spherical shape of the depressions, combined with the high diameter to depth ratio, causes a turbulence in the flow of slurry within the depressions, especially near their peripheries. The result is a more effective use of the abrasive particles suspended in the abrasive slurry, increasing the lapping rate, particularly as compared to the expected rate for a similar surface area provided with steep-walled grooves.

Another aspect of the present invention is a process for manufacturing an abrading tool having a desired surface texture for a lapping surface of the tool. The process comprises the steps of:

(a) machining a lapping surface of an abrading tool to a desired planarity;

(b) forming in the lapping surface a plurality of generally spherical depressions, spaced apart from one another, generally uniformly distributed over the lapping surface, and together comprising from twenty-five percent to sixty-five percent of the surface area of the lapping surface, with the remainder of the lapping surface comprising a substantially planar surface portion; and (c) fixing a plurality of abrasive particles to the planar surface portion.

Preferably, the depressions are formed by propelling a plurality of substantially spherical members against the lapping surface, with the spherical members constructed of a material such as glass, harder than the material forming the lapping surface. Glass beads with a nominal diameter of about ten one-thousandths of an inch have been used to form depressions of a diameter of approximately five thousandths and a seven hundred microinch depth. A further refinement in the process involves machining the lapping surface for planarity after forming the depressions with the glass beads and prior to fixing the abrasive particles. This restores the desired planarity of the plateau portion of the lapping surface, principally by removing any extrusion ridges at the boundaries of the depressions.

To distribute the cavities with the desired uniformity, the glass beads preferably are propelled serially against the lapping surface of the lapping disc while the disc is rotating, and with the nozzle propelling the glass beads traversing an arcuate path in a plane which also contains the lapping plate rotational axis. Cavity density can be controlled by regulating the application time or the amount of glass beads supplied to the nozzle.

Thus formed, the spherical cavities have a uniformity and density of distribution over the lapping surface superior to that of prior art grooves. As a consequence, lapping plates textured in accordance with the present invention provide more consistent lapping action throughout their useful lives, and when used to lap relatively large workpieces, have been found to last nearly ten times as long as a comparable lapping plate with a flat lapping surface. At the same time, given the small nominal pit depth, such a disc may be refurbished repeatedly by simply abrading the lapping surface to remove all pits, then retexturizing. Better co-planarity is achieved when lapping composite heads. Pole tip recession, a problem described in co-pending U.S. patent application Ser. No. 123,967 (Holmstrand), filed concurrently herewith, has been reduced from an average of 2.4 microinches to 1.5 microinches in accordance with the apparatus described in that application, and has been further reduced to 1.1 microinches when utilizing a lapping surface textured in accordance with the present invention.

IN THE DRAWINGS

For a better appreciation of the above and other features and advantages, reference is made to the following detailed description and drawings, in which.

DETAILED DESCRIPTION OF THE PREFERRED EMBODIMENT

Figure 1:
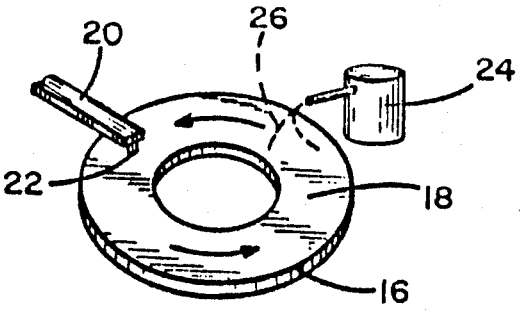
FIG. 1 is a perspective view of a lapping plate constructed in accordance with the present invention.

Turning now to the drawings, there is shown in FIG. 1 a lapping plate 16 rotatable about a vertical axis and having a substantially flat and horizontal lapping surface 18. A workpiece carrier arm 20 supports a workpiece 22 against the lapping surface, so that the bottom surface of the workpiece is abraded as lapping plate 16 is rotated. A container 24 supplies an abrasive slurry 26 to the lapping surface. Particles (e.g. diamond fragments one to ten microinches in diameter preferred, but possibly up to two hundred fifty microinches) in the slurry contribute to the abrading action. Abrasive slurry 26 is carried to the workpiece by the rotating lapping plate. For a further explanation of the abrading system employing lapping plates such as plate 16, reference is made to the aforementioned U.S. Pat. No. 4,536,992.

Figure 2:
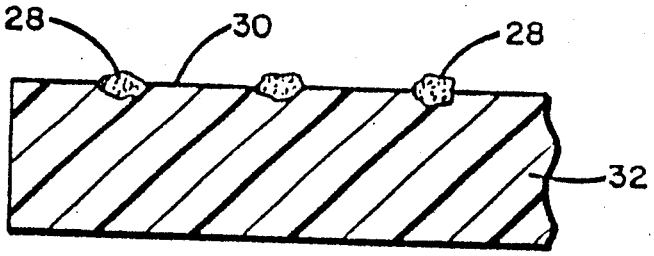
PRIOR ART Fig. 2
FIG. 2 is an enlarged side sectional elevation of a lapping plate of the prior art.

Usually there are two sources of abrasion: abrasive grit suspended in the abrasive slurry, and further abrasive particles embedded in the lapping surface. These latter particles are shown at 28, embedded in a substantially flat lapping surface 30 of a prior art lapping plate 32 (FIG. 2). Lapping plate 32 experiences rapid degradation during abrading, due to build-up of material removed from the workpiece and the hydroplaning effect of the abrasive slurry in elevating the workpiece.

Figure 3:
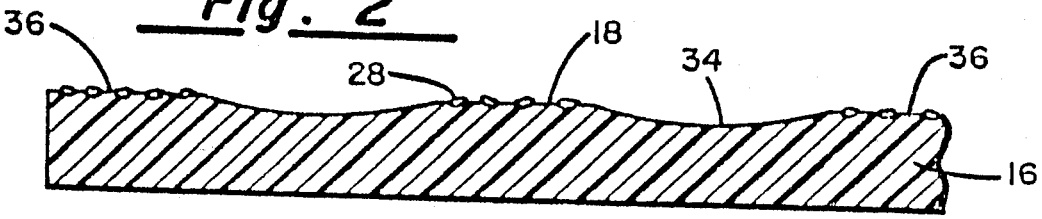
FIG. 3 is an enlarged side sectional elevation of a portion of the lapping plate in FIG. 1.

An enlarged portion of lapping plate 16 is shown in FIG. 3. To reduce hydroplaning and extend the useful life of the lapping plate 16, a plurality of cavities or depressions 34 are formed in the lapping plate along lapping surface 18. Cavities 34 effectively divide lapping surface 18 into two separate regions, including a cavitated region and a substantially planar plateau 36.

Abrasive particles such as diamond fragments 28 are embedded in plateau 36. Cavities 34 preferably have a diameter (taken along the plane of plateau 36) of about five thousandths of an inch. However, cavity diameters can range from about two to twenty thousandths of an inch, and it is not critical that the cavity diameters be uniform. The maximum cavity depth should be less than one-fourth of its diameter, and preferably is less than one-sixth of a diameter. For example, given a typical cavity diameter of five one-thousandths of an inch, the typical depth is approximately seven hundred microinches.

Figure 4:
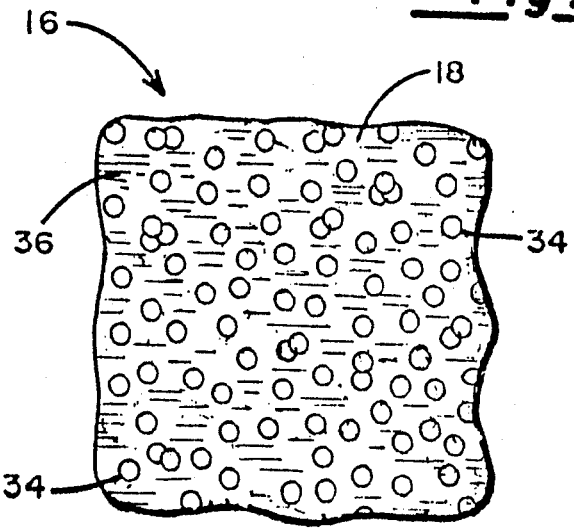
FIG. 4 is a top plan view of a portion of the lapping plate of FIG. 1.

As is best seen in FIG. 4, depressions 34 are generally spherical and cover a substantial area of lapping surface 18. The portion of the lapping surface shown in FIG. 4 is small (approximately 0.1 inches square) but representative of the lapping surface, as cavity distribution is preferably uniform over the entire lapping surface. Cavities 34 are for the most part spaced apart from one another, although occasionally a pair of cavities may be formed adjacent one another. Cavities 34 together cover approximately forty to fifty percent of lapping surface 18, with the remainder of the lapping surface consisting of plateau 36. The cavities thus represent a substantial portion of the lapping surface not embedded with abrasive particles 28. However, this has not been found to substantially reduce abrading efficiency. It is believed that cavities 34 create turbulence in the abrasive slurry, particularly near the periphery of each cavity, which increases the abrading action of particles suspended in the slurry and counters the effect of reducing the surface area of plateau 36.

Figure 5:
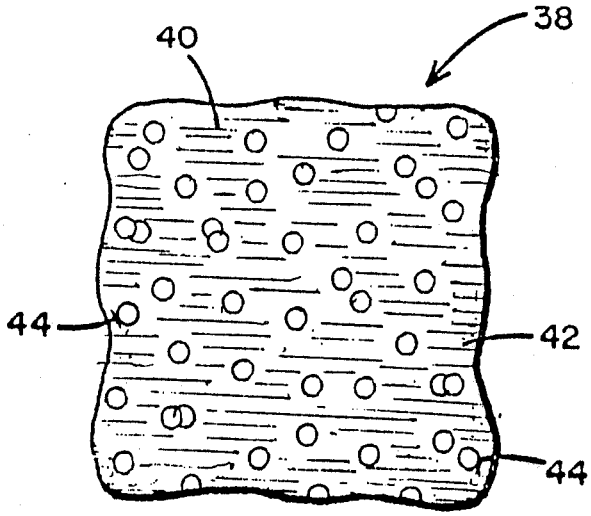
FIG. 5 is a top plan view similar to that of FIG. 4 showing a portion of an alternative embodiment lapping plate.

FIG. 5 illustrates an approximately 0.1 inch x 0.1 inch portion of an alternative lapping plate 38 in which a lapping surface 40 is formed of approximately seventy percent plateau 42, and about thirty percent of the area covered by cavities 44, which are about the same size as cavities 34. Textured surfaces may be formed with cavities occupying from about twenty-five to about sixty-five percent of the lapping surface area. Where surface discontinuity to reduce hydroplaning is the primary concern, the cavity density is higher, while a lower density is preferred when there is a need to maximize the plateau area where abrasive particles 28 may be embedded.

A salient feature of the present invention is the uniformity of the lapping surface, even over the relatively small scale of the surface areas shown in FIGS. 4 and 5. Prior art texturizing such as the cutting of grooves illustrated in the aforementioned U.S. Pat. Nos. 4,037,367 (Kruse) and 3,921,342 (Day) cannot achieve this degree of uniformity, nor even approach it without inordinately expensive and time consuming cutting or grinding.

Figure 6:
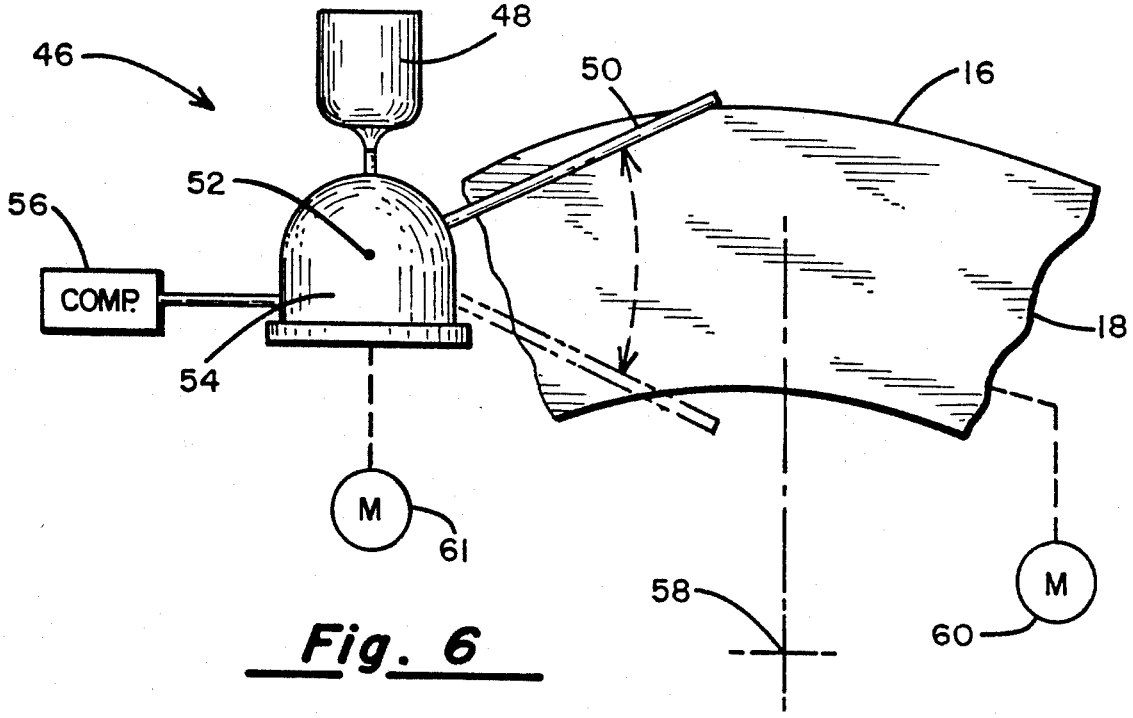
FIG. 6 is a schematic view illustrating apparatus employed in forming a lapping surface of the lapping plate of FIG. 1.

FIG. 6 illustrates a bead blasting apparatus 46 utilized to form cavities 34 to achieve the desired density and uniformity. In particular, a plurality of spherical glass beads, loaded into a bead container 48, are supplied to a guide tube or nozzle 50 mounted to pivot about a pivot axis 52 with respect to a fixed support 54. An air compressor 56 provides air at an elevated pressure sufficient to project the glass beads rapidly and serially through nozzle 50 and onto lapping surface 18 of lapping plate 16. The lapping plate is supported, by means not illustrated, on a rotational axis 58 which appears as a point in the figure.

A motor 60 rotates lapping plate 16 about axis 58, and a second motor 61 reciprocates nozzle 50 over an arcuate path, the extremes of which are indicated by the upper position of the nozzle shown in solid lines, and the lower nozzle position indicated in broken lines. The use of separate motors to rotate lapping plate 16 and to reciprocate nozzle 50 enables their asynchronous operation. The rate of nozzle reciprocation, the plate rotation rate, and their precise relationship do not appear critical. However, synchronizing these rates should be avoided, for more random cavity distributions, which tend to be more uniform.

As motor 60 rotates the lapping plate and reciprocates the nozzle, the glass beads are projected onto lapping surface 18 with sufficient force to partially penetrate it, thus forming cavities 34. Nozzle 50 is spaced apart from lapping plate 16 a desired distance in the direction of axis 58, i.e. normal to the plane of FIG. 6. The beads are projected toward the plate in this direction. It is preferred that the glass beads be generally uniform in diameter, resulting in cavities or depressions of a generally uniform diameter and depth. Controlling the cavity density is controlled in a straightforward manner, either by controlling the number of glass beads loaded into container 48, or in setting the operating time of apparatus 46. Thus, cavity density can be reduced as shown in FIG. 5 as compared to FIG. 4, or alternatively increased.

Figure 7:
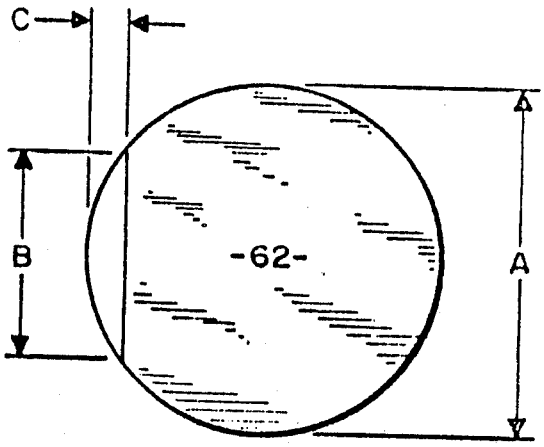
FIG. 7 illustrates a spherical glass bead used in forming the lapping surface.

Shown in FIG. 7 is a glass bead 62 typical of the beads used to form cavities 34. Bead 62 has a diameter A of about 0.01 inches, and is propelled against the lapping surface at a speed sufficient for penetration of the lapping plate a distance C, so that the cavity formed will have a depth equal to C and a diameter equal to B. Typically, B is approximately half of diameter A, or about 0.005 inches, to yield a depth C of about seven hundred microinches and a ratio B/C of about seven. If desired, the cavity depth and diameter can be varied, by changing the bead size, the speed at which the beads are projected onto the lapping surface, or both.

As noted above, beads 62 are preferably of glass and spherical in shape. Glass beads are substantially harder than the lapping plate material (e.g. lead), ensuring that cavities conform to the shape of the beads, and also minimizing the possibility of cavity contamination from bead fragments breaking off during formation. The smooth, spherical bead configuration reduces the chances for bead fragmenting as the beads form cavities having the desired smoothness and shape.

Figure 8:
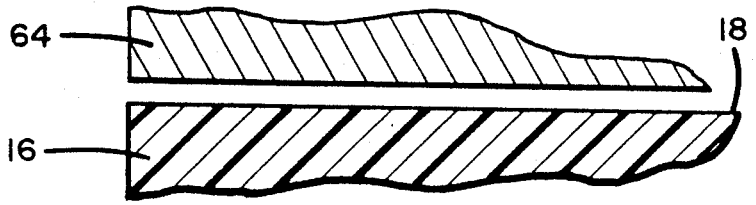
FIGS. 8–11 illustrate a portion of the lapping plate of FIG. 1 in various stages of formation of the lapping surface.
Figure 9:
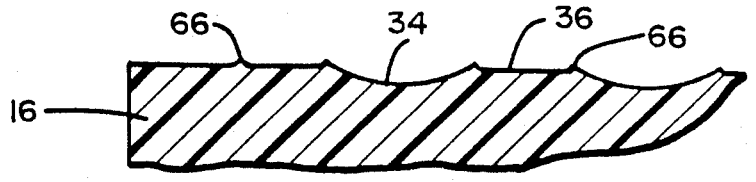
Figure 10:
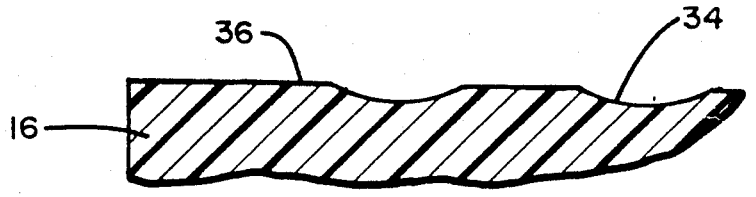

FIGS. 8–11 illustrate the process for texturizing lapping plate surfaces in accordance with the present invention. The first step, illustrated in FIG. 8, is to abrade the top of lapping plate 16 to form smooth, planar lapping surface 18. This is accomplished by moving an abrading tool 64 relative to lapping plate 16, usually rotationally, with the tool maintained against the lapping surface.

Next, the apparatus of FIG. 6 is employed to propel glass beads 62 against lapping surface 18, with the bead size and speed (a function of air pressure) selected to form the cavities of the desired diameter and depth, and with either operating time or bead supply controlled to determine the density of the cavities. As a result, lapping surface 18 consists mainly of cavities 34 and plateau 36. Also, however, there may be an undesirable build-up of lapping plate material ridges near the cavity edges, due to the impact of the beads against the lapping surface, as illustrated at 66. Consequently, it may be desirable or necessary to use abrading tool 64 once again, to remove ridges 66 from the remainder of the lapping surface, with the results of this further machining shown in FIG. 10.

Finally, lapping plate 16 is charged with abrasive particles. Charging is accomplished by providing an abrasive slurry 68 over the lapping surface, which slurry contains a grit such as diamond particles. Slurry can be, though need not be, the same as slurry 26. Then, a pressure member 70, constructed of a material harder than the lapping plate, is pressed against the lapping surface to cause at least some of the abrasive particles in slurry 68 to become embedded into the lapping surface, particularly over plateau 36. At this point, lapping plate 16 is ready for use in abrading workpieces, as explained in the aforementioned U.S. Pat. No. 4,536,992.

Figure 11:
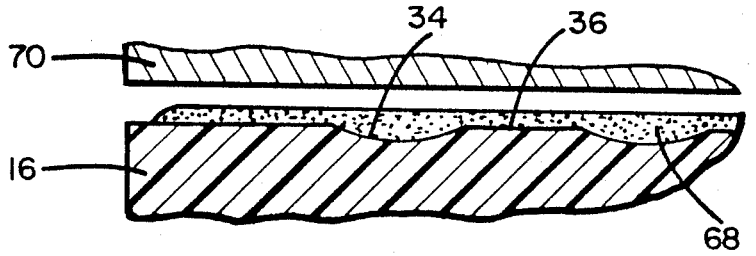

When lapping plate 16 requires refurbishment, lapping surface 18 is machined with abrading tool 64 and returns to the form illustrated in FIG. 8 to restore flatness, whereupon it is re-blasted, and re-charged using an abrasive slurry and pressure member as discussed in connection with FIG. 11.

Cavities 34 substantially increase the useful life of lapping surface 18, as they provide receptacles for workpiece fragments, loose abrasive particles and any other matter which otherwise would accumulate between embedded grit particles on a flat lapping surface, reducing scratching of workpieces. The maximum cavity depth, for example seven hundred microinches as discussed above, is substantially larger than the nominal grit size used in abrading sliders, e.g. one–ten microinches. It has been found that lapping plate 16, as opposed to totally planar lapping plates, can be used to abrade more than ten times the number of workpieces before refurbishment, and with greater lapping consistency. The cavities are sufficiently large in diameter to reduce hydroplaning of workpieces, yet are sufficiently small to permit use of lapping plate 16 to abrade relatively small workpieces. The reduced hydroplaning effect is particularly noticeable when lapping plate 16 is employed to generate curved sliders, and results in more uniform curvature.

Finally, lapping surface 16 yields improved coplanarity of features, particularly in connection with lapping composite materials. In the aforementioned co-pending patent application Ser. No. 123,967, it was noted that use of the wiping guide reduced pole tip recession from 2.4 microinches to 1.5 microinches. It has been found that use of the wiper guide, augmented by use of a lapping plate textured in accordance with the present invention, results in a further reduction in pole tip recession, to 1.1 microinches.

A further advantage of forming cavities with spherical glass beads, in combination with the shallow penetration of the lapping surface, is the formation of cavities with smooth, gradually inclined side walls, as opposed to the nearly vertical side walls of the prior art grooves. It is believed that the gradually inclined peripheral cavity walls assist in causing turbulent flow in the abrasive slurry, particularly near the cavity boundaries, effectively increasing the plateau portion of the lapping surface to improve abrading efficiency. This turbulent flow also is believed to reduce hydroplaning of workpieces. As a contrast to steep walled grooves, the shallow, spherical depressions can occupy a larger share of the lapping surface area without unduly sacrificing abrading efficiency, while substantially eliminating workpiece hydroplaning.

What is claimed is:

1. A process for manufacturing an abrading tool having a desired surface texture for a lapping surface of the tool, comprising the steps of:

machining a lapping surface of an abrading tool to a desired planarity;

after said machining, forming in said lapping surface a plurality of generally spherical depressions, spaced apart from one another, generally uniformly distributed over the lapping surface, and together comprising from twenty-five percent to sixty-five percent of the surface area of said lapping surface, with the remainder of said lapping surface comprising a substantially planar surface portion having said desired planarity; and after forming said depressions, fixing a plurality of abrasive particles to said planar surface portion.

2. The process of claim 1 wherein:

the step of forming said depressions includes propelling a plurality of substantially spherical members against said lapping surface, with the spherical members constructed of a material harder than the material defining said lapping surface.

3. The process of claim 2 wherein:

said spherical members comprise glass beads having a nominal diameter of approximately ten one-thousandths of an inch.

4. The process of claim 3 wherein:

said abrasive particles have diameters no greater than two hundred fifty microinches.

5. The process of claim 4 wherein:

said abrasive particles have diameters within the range of from one to ten microinches.

6. The process of claim 2 wherein:

the step of forming the depressions further includes providing a guide tube for propelling said spherical members, supporting said abrading tool movably with respect to said guide tube and with said lapping surface exposed to said guide tube, and reciprocating said guide tube in a direction generally parallel to said lapping surface.

7. The process of claim 2 wherein:

said abrading tool is supported to rotate about an axis with respect to said guide tube, and said guide tube is pivotally reciprocated over an arcuate path contained in a plane substantially perpendicular to said axis.

8. The process of claim 7 wherein:

said abrading tool is so rotated and said guide tube is so reciprocated, respectively, at asynchronous rates.

9. The process of claim 2 further including the step of:

further machining said lapping surface, after forming said depressions and prior to fixing said abrasive particles, to restore said desired planarity.

10. The process of claim 1 wherein:

the step of fixing said abrasive particles includes the step of applying an abrasive slurry containing said abrasive particles to said lapping surface, and then forcing a substantially flat pressure member against said surface to embed at least a portion of said abrasive particles into said planar surface portion.

11. The process of claim 1 wherein:

said spherical depressions have diameters in the range of from two to twenty-thousandths of an inch, and the depth of each depression is less than one-fourth of its diameter.

* * * * *